United States Patent [19]

Wolter

[11] 4,287,673

[45] Sep. 8, 1981

[54] HAIR DRYER DIFFUSER

[75] Inventor: Gilbert R. Wolter, Elmhurst, Ill.

[73] Assignee: Sunbeam Corporation, Chicago, Ill.

[21] Appl. No.: 111,413

[22] Filed: Jan. 11, 1980

[51] Int. Cl.[3] ..... F26B 23/04

[52] U.S. Cl. ..... 34/97; 34/243 R; 219/359; 219/369; 219/373; 239/524; 239/590

[58] Field of Search ..... 34/96, 97, 98, 243; 285/322, 399; 239/499, 500, 524, 590; 219/359, 366, 368, 369, 370, 371, 373

[56] References Cited

U.S. PATENT DOCUMENTS

| | | | |
|---|---|---|---|
| 619,556 | 2/1899 | Fraser | 285/322 |
| 720,538 | 2/1903 | Wallace | 285/322 |
| 1,961,179 | 6/1934 | Tinkham | 219/368 |
| 3,077,531 | 2/1963 | Wompey | 219/368 |
| 3,837,581 | 9/1974 | Orsoff | 239/135 |
| 3,943,329 | 3/1976 | Hlavac | 34/96 |
| 4,114,022 | 9/1978 | Braulke | 34/97 |
| 4,230,279 | 10/1980 | Forsberg | 34/243 R |

*Primary Examiner*—Larry I. Schwartz

*Attorney, Agent, or Firm*—George R. Clark; Neil M. Rose; Clifford A. Dean

[57] ABSTRACT

A diffuser attachment which is telescopically assembled to the air outlet end of a hand-held hair dryer and which is characterized by a forwardly flared body portion and by a diffuser plate concentrically mounted within the flared body portion and having a convex surface facing the flow of heated air from the hair dryer.

4 Claims, 3 Drawing Figures

28
44
42
14
46
38
36
10
34
18
12
18
30
32
16
26

3.
10

44
46
34
46
44
28
46
32
38
44
40
30

3.

32
10
44
42
34
14
12
22
20
48
40
38
48
46
44
42
36
24
28
30

HAIR DRYER DIFFUSER

BACKGROUND OF THE INVENTION

With the high-wattage hand-held hair dryers which are currently enjoying wide usage, the air flow must be at relatively high volume, because of the high wattage rating of the hair dryers, to prevent overheating thereof. Thus, although such hair dryers are very effective in drying hair, the user must be very careful not to burn the scalp, particularly because of the center "hot spot" common to most of such hair dryers. Further, the high speed air flow makes it quite difficult to properly style the hair.

Therefore, there is a definite need for a low-cost means for converting the high speed flow of hot air of a high-wattage hand-held hair dryer into a gentle flow of warm air whereby to facilitate styling of the hair.

SUMMARY OF THE INVENTION

The present invention is directed to a low-cost diffuser which is readily attachable to the air outlet end of a hand-held hair dryer.

The subject diffuser attachment for a hand-held hair dryer is characterized by a forwardly flared body portion having a parabolic configuration and a reduced diameter rear neck portion which is adapted to be telescopically assembled over the air outlet end of a hand-held hair dryer and by a diffuser plate which is concentrically mounted within the flared body portion and has a convex surface facing the flow of heated air from the air outlet end of the hair dryer. The diameter of the diffuser plate is greater than the diameter of the air outlet end of the hair dryer whereby the flow of heated air is gently diffused between the periphery of the diffuser plate and the parabolic configuration of the body portion for more effective hair styling.

DETAILED DESCRIPTION OF THE INVENTION

Figure 1:
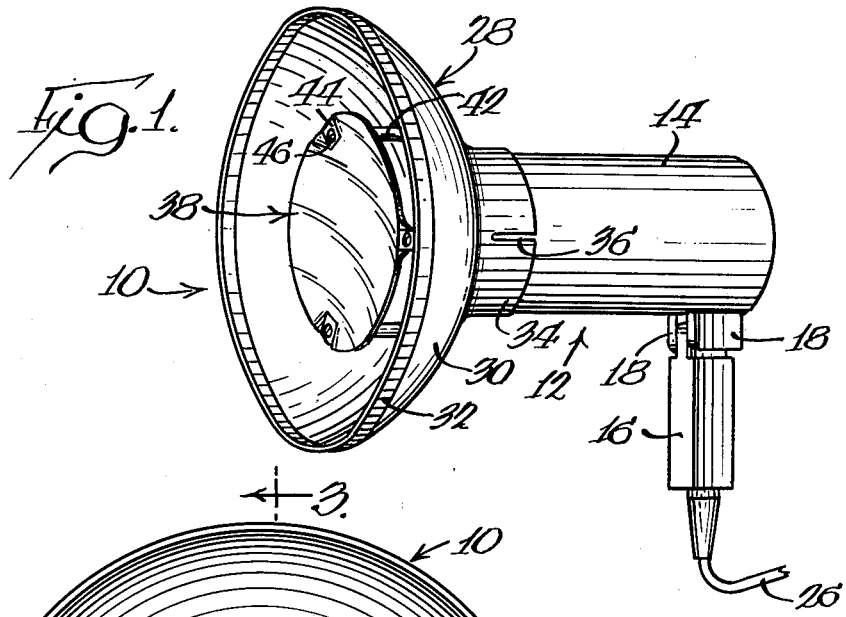
FIG. 1 is a perspective view of a diffuser attachment embodying the invention, the diffuser attachment being shown assembled on a hand-held hair dryer.
Figure 2:
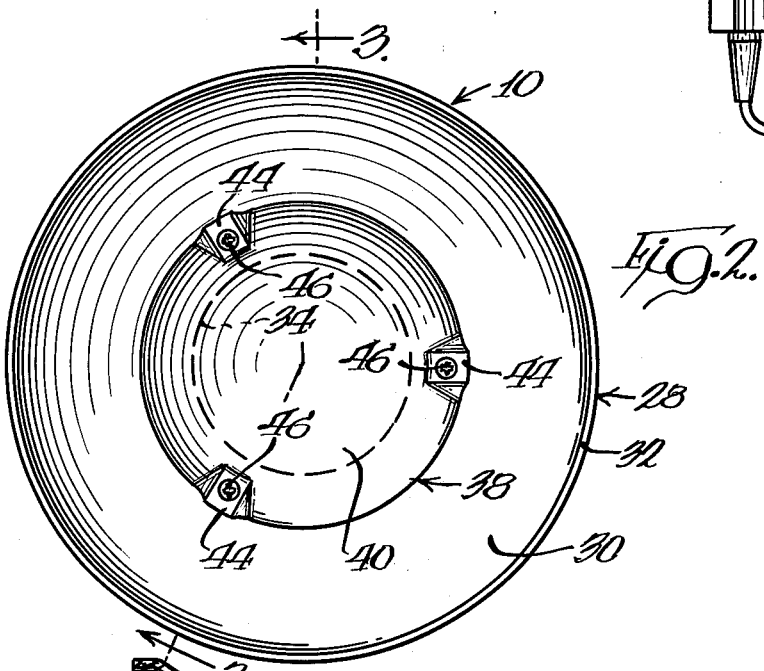
FIG. 2 is a front elevational view thereof.
Figure 3:
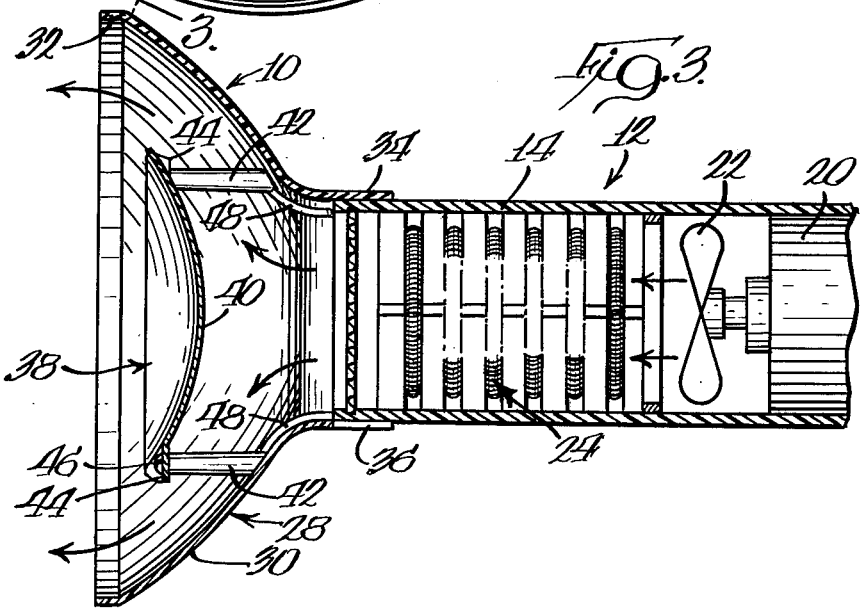
FIG. 3 is a vertical sectional view taken generally along line 3—3 of FIG. 2.

As illustratedin FIG. 1, a diffuser attachment 10 embodying the invention is shown assembled on the air outlet end of a suitable hand-held high-wattage hair dryer 12 having a cylindrical body portion 14 with a handle 16 pivotally mounted in a known manner between a pair of lugs 18, which depend from the rear end of the body portion 14. As shown in FIG. 3, an electric motor 20, a fan 22 operable thereby, and a heater assembly 24 are disposed within the body portion 14 of the hair dryer 12 to provide a flow of heated air through the air outlet end thereof. A power cord 26 (FIG. 1) extends through the handle 16 for connection to the electric motor 20 and the heater assembly 24 in a known manner.

The diffuser attachment 10, which serves to diffuse the flow of hot air whereby to provide a gentle flow of warm air for styling the hair and which also permits use of the hair dryer 12 closer to the head because of the elimination of the usual center "hot spot" which may burn the scalp, is characterized by a forwardly flared body portion 28 molded of high-temperature-resistant plastic and having a parabolic configuration central portion 30 with a short cylindrical portion 32 at its forward open end and a reduced diameter neck portion 34 at its rear open end which is adapted to be telescopically assembled over the air outlet end of the body portion 14 of the hair dryer 12. The neck portion 34 is preferably provided in its rear edge with a series of three, circumferentially spaced, longitudinally extending, rearwardly opening slots 36 which facilitate telescopic assembly of the diffuser attachment 10 on the air outlet end of the hair dryer 16 by providing some neck portion 34 flexibility for tolerance compensation.

A thin metallic diffuser plate 38 is coaxially mounted within the parabolic central portion 30 of the diffuser body portion 28 rearwardly of the short cylindrical portion 32 and forwardly of the neck portion 34 and has a convex surface 40 facing the flow of heated air from the hair dryer 12. The outer diameter of the diffuser plate 38 is somewhat greater than the diameter of the air outlet end of the hair dryer 12 whereby the convex surface 40 thereof in combination with the parabolic configuration of the central portion 30 of the diffuser body portion 28 serves to gently and effectively diffuse the flow of heated air from the hair dryer 12. As is evident from FIG. 3 of the drawings, the radial dimension of the annular gap defined between the forward edge of the diffuser plate 38 and the inner surface of the parabolic central portion 30 of the forwardly flared body portion 28 in a transverse plane defined by the forward edge of the diffuser plate 38 is approximately one-fifth of the inner diameter of the parabolic central portion 30 in the same transverse plane.

The diffuser plate 38 is mounted on the forward ends of a series of three forwarding projecting posts 42 which are integrally formed on the inner surface of the diffuser body portion 28 is equidistantly spaced relationship, the peripheral edge of the diffuser plate 38 being provided with a series of three rearwardly formed flat portions 44 which are spaced for engagement against the forward ends of the posts 42. The posts 42 are provided with threaded bores and the diffuser plate flat portions 44 are provided with punched-out holes whereby the diffuser plate 38 is mounted on the posts 42 by threaded fasteners 46.

Preferably, the posts 42 and the neck portion slots 36 are longitudinally aligned and a series of three raised ribs 48 (FIG. 3) are formed on the inner surface of the diffuser body portion 28 and extend longitudinally between the posts 42 and the forward ends of the slots 36. The rear ends of the ribs 48 are engageable with the front edge of the air outlet end of the cylindrical body portion 14 of the hair dryer 12 and serve as stop members during telescopic assemble of the diffuser attachment 10 on the hair dryer 12.

While there has been shown and described a preferred embodiment of the present invention, it will be apparent to those skilled in the art that various changes and modifications may be made without departing from the invention in its broader aspects and it is, therefore, contemplated in the appended claims to cover all such changes and modifications that fall within the true spirit and scope of the present invention.

What is claimed as new and desired to be secured by Letters Patent of the United States is:

1. A diffuser attachment for a hair dryer comprising a forwardly flared body portion wherein the maximum diameter portion thereof is at its forwardmost edge and having a reduced diameter rear neck portion adapted to be telescopically assembled on the air outlet end of the hair dryer, a diffuser plate concentrically mounted within said forwardly flared body portion with its forward edge spaced rearwardly of said forwardmost edge of said flared body portion and having a convex surface facing the flow of heated air from the hair dryer, the diameter of said diffuser plate being greater than the diameter of said air outlet end of the hair dryer but substantially less than the inner diameter of said flared body portion in a transverse plane defined by the forward edge of said plate whereby an annular gap defined therebetween has a radial dimension in said plane approximately one-fifth of the inner diameter of said flared body portion in said plane, and said forwardly flared body portion having a parabolic configuration with a short cylindrical portion at its forward edge.

2. The diffuser attachment of claim 1 wherein said neck portion is provided with a series of rearwardly opening longitudinally extending slots which facilitate the telescopic mounting of the diffuser on the hair dryer and wherein the inner surface of said body portion is provided with a series of longitudinally extending raised stop ribs which are aligned with and which terminate even with the forward ends of said neck portion slots with the rear ends of said ribs being engageable with the forward edge of the air outlet end of the hair dryer.

3. A diffuser attachment for a hair dryer comprising a forwardly flared body portion characterized by a central portion having a parabolic configuration, by a reduced diameter rear neck portion adapted to be telescopically assembled on the air outlet end of a hair dryer, and by a short cylindrical front portion, and a diffuser plate concentrically mounted within said parabolic central portion of said flared body portion on the forward ends of a series of posts which extend forwardly from the inner surface of said forwardly flared body portion, said diffuser plate having a diameter greater than the diameter of said air outlet end of the hair dryer but substantially less than the inner diameter of said parabolic central portion in a transverse plane defined by the forward edge of said diffuser plate whereby an annular gap defined therebetween has a radial dimension in said plane approximately one-fifth of the inner diameter of said parabolic central portion in said plane and a convex surface facing the flow of heated air therefrom.

4. The diffuser attachment of claim 3 wherein the periphery of said diffuser plate is provided with a series of rearwardly formed flat portions adapted for engagement against the forward ends of said posts, and wherein threaded fasteners extend through said flat portions and into said posts to fixedly attach said diffuser plate thereto.

* * * * *